US009579644B2

(12) United States Patent
Belgardt et al.

(10) Patent No.: US 9,579,644 B2
(45) Date of Patent: Feb. 28, 2017

(54) PIPETTE FOR OPERATING A SYRINGE

(71) Applicant: Eppendorf AG, Hamburg (DE)

(72) Inventors: Herbert Belgardt, Hamburg (DE); Jörg Sattler, Hamburg (DE); Burkhardt Reichmuth, Hamburg (DE); Winfried Schmidt, Ansbach (DE)

(73) Assignee: Eppendorf AG, Hamburg (DE)

( * ) Notice: Subject to any disclaimer, the term of this patent is extended or adjusted under 35 U.S.C. 154(b) by 497 days.

(21) Appl. No.: 13/867,731

(22) Filed: Apr. 22, 2013

(65) Prior Publication Data

US 2013/0319139 A1 Dec. 5, 2013

Related U.S. Application Data

(60) Provisional application No. 61/636,992, filed on Apr. 23, 2012.

(51) Int. Cl.
*B01L 3/02* (2006.01)

(52) U.S. Cl.
CPC ..... *B01L 3/021* (2013.01); *B01L 3/0234* (2013.01); *B01L 2200/087* (2013.01); *B01L 2200/141* (2013.01)

(58) Field of Classification Search
None
See application file for complete search history.

(56) References Cited

U.S. PATENT DOCUMENTS 4,406,170 A 9/1983 Kuhn
5,591,408 A 1/1997 Belgardt et al.
5,620,660 A 4/1997 Belgardt et al.
5,620,661 A 4/1997 Schürbrock
7,731,908 B2 6/2010 Lenz
8,133,453 B2 * 3/2012 Molitor ..... 422/501
2009/0004063 A1 * 1/2009 Higashihara ..... G01N 35/0099 422/400

(Continued)

FOREIGN PATENT DOCUMENTS

CN 101497056 A 8/2009
DE 2926691 6/1981

(Continued)

*Primary Examiner* — Robert R Raevis
(74) *Attorney, Agent, or Firm* — Vidas Arrett & Steinkraus

(57) ABSTRACT

Pipette for operating a syringe with a bar-shaped housing, a fixture with an opening at the lower end of the housing for putting in a syringe with a fastening portion on the upper edge of a cylinder, a fixture body with a further fixture and a further opening on the lower end of the housing, for putting in a further fastening portion of a piston of the syringe, means for detachably holding the fastening portion in the fixture and the further fastening portion in the further fixture, means for displacing the fixture body within the housing in the longitudinal direction of the housing, which have a draw-up lever activated from the outside of the housing, which is connected to the fixture body via a connection element which grips through a straight slit extending in the longitudinal direction of the housing, wherein below the slit in the housing, a cover stripe covering the slit is held in the housing at two positions spaced apart from each other in the longitudinal direction of the slit, and wherein the connection element has a channel through which the cover stripe extends.

19 Claims, 5 Drawing Sheets

(56) References Cited

U.S. PATENT DOCUMENTS

2012/0016234 A1* 1/2012 Nemoto ..... A61M 5/14546
600/432

FOREIGN PATENT DOCUMENTS

| | | |
|---|---|---|
| DE | 3211271 | 9/1983 |
| DE | 4437716 | 7/1996 |
| DE | 19541628 | 5/1997 |
| EP | 0656229 | 6/1995 |
| EP | 0657216 | 6/1995 |
| EP | 0679439 | 11/1995 |
| EP | 1724020 | 11/2006 |

* cited by examiner

PIPETTE FOR OPERATING A SYRINGE

CROSS-REFERENCE TO RELATED APPLICATIONS

This application claim priority to provisional patent application No. 61/636,992 filed Apr. 23, 2012, the entire contents of which are hereby incorporated by reference.

STATEMENT REGARDING FEDERALLY SPONSORED RESEARCH

Not applicable

BACKGROUND OF THE INVENTION

The present invention relates to a pipette for operating a syringe.

The pipettes for operating a syringe discussed here serve for discharging liquids taken up into the syringe in several steps. They are also called dispensers or repeater pipettes. At the lower end of a bar-shaped housing, these pipettes have a fixture for a flange of a cylinder of the syringe, and in the housing a displaceable fixture body with a piston fixture for the upper end portion of a piston rod of a piston of the syringe. The syringe can be inserted with the flange and the end portion of the piston rod through axially oriented openings of the fixtures. The flange and the end portion are held in the fixtures by means for detachable holding, which are for instance configured as spring-tensioned gripping levers. Further, the pipette has means for displacing the fixture body, which permit to draw the piston partially out of the cylinder in order to aspirate liquid into the syringe, and to push it stepwise into the cylinder for stepwise discharge of liquid.

The documents DE 2926691 C2 and U.S. Pat. No. 4,406,170 A, the entire contents of each of which are incorporated herein by reference, describe means for displacing the fixture body in the housing. These comprise a draw-up lever, connected to the fixture body and projecting out of the housing through a straight slit, for aspirating liquid into the syringe by moving the fixture body away from the fixture. They further comprise a tooth bar pawl device for stepwise piston forward movement by a reciprocating metering lever. A pivotal pawl is bearing mounted on the metering lever. The tooth bar is connected to the fixture body and arranged in the pivot region of the pawl. An adjustably movable covering more or less covers up the tooth row on the tooth bar, in order to limit the engagement of the pawl into the tooth bar when the metering lever is swung. Further, the tooth bar is designed with a contour, by which the covering can be moved away from the tooth bar when the piston is in an advanced position, so that it prevents the pawl from engaging with those teeth of the tooth bar that are not covered. Through this, it is prevented that a residual amount is discharged from the syringe, which is smaller than the metering amount which is to be discharged in each metering step.

Further developments of the means for displacing the fixture body are described in the documents DE 4437716 C2, EP 0679439 B1 and U.S. Pat. No. 5,591,408 A, the entire contents of each of which are incorporated herein by reference.

Further developments of the means for fastening are described in the documents EP 0656229 B1 and U.S. Pat. No. 5,620,660 A, the entire contents of each of which are incorporated herein by reference. The documents EP 1724020 B1 and U.S. Pat. No. 7,731,908 B2, the entire contents of each of which are incorporated herein by reference, describe a further development of the fastening devices which permits to detach the syringe from the pipette using only one hand.

The documents EP 0657216 B1 and U.S. Pat. No. 5,620,661 A, the entire contents of each of which are incorporated herein by reference, describe such a pipette with a sensor for gauging protrusions and deepenings on the syringe flange and associated syringes. The sensor serves to determine the size of the utilized syringe. On the basis of the set step width, an electronics determines the amount of liquid that is discharged in each discharging step. This is indicated on a display.

In a functional embodiment of the pipette, the fixture body is fixedly connected to a rigid cover stripe, which covers the slit from the inside. The cover stripe extends from the fixture body towards the upside, so that it covers only the slit above the draw-up lever. Below the draw-up lever, there is no sufficient space for a further cover stripe. When the draw-up lever is thrust towards the upside, the cover stripe moves to the upside in the housing, and the slit opens below the draw-up lever. In the known pipette, unintended movement of the fixture body and of the draw-up lever connected thereto are prevented in that the fixture body is braked by two elastic hoses which are disposed in the housing of the pipette.

The opened slit permits insight into the casing's interior and also the intrusion of dirt into the housing, which contaminates the mechanical and, as the case may be, the electronic components of the pipette.

The document DE 32 11 271 A1, the entire contents of which is incorporated herein by reference, describes a slide bar control device with slits on the activation elements for heating and venting, in air conditioning apparatuses of motor vehicles in particular. In the slide bar control device, a tape is attached behind the slit or behind the slits, respectively, whose ends are fastened on the base body. The tape is guided through a breakthrough of an actuating lever of the slide bar control device. The tape is disposed at a distance to the slit, so that there is a cavity between slit and tape through which dirt can enter the base body. The tape prevents exterior light from leaving the slide bar control device, and at the same time, it reduces contamination of the inner construction.

The document DE 195 41 628 C2, the entire contents of which is incorporated herein by reference, describes a sliding controller of for instance a sliding variable resistor, or for changing the tension of a spring in a mechanical system, or realised as a program selection lever for an automatic gearbox in motor vehicles. The sliding controller has a housing with a slit, and a sliding block movable in and along the slit, with a take-up side and a take-along side attached thereto and extending through the slit. The sliding controller has a flexible tape extending only in the slit direction. The tape runs above the slit in a groove on the side of the housing directed towards the take-up side and extends across a recess in the sliding block. At its ends, the tape is fixed on the housing, wherein the distance of the fixation points is smaller than the length of the tape extending between them. The tape seals the slit at those positions of the slit where the sliding block is not present. Due to its arrangement at the outer side of the housing, the tape may easily be contaminated and damaged. In one embodiment, the recess in the sliding block is realised by a laterally formed slit in the take-up side of the sliding block. The lateral arrangement of the slit permits lateral exit of the tape. Moreover, it compromises the outer appearance of the sliding block. According to another embodiment, the sliding block is formed by two essentially symmetric halves bearing against each other, which consist of one half at the take-up side and one half at the take-along side, wherein the recess is formed by slits in the contact surface of each one of the two halves, with a depth corresponding to at least half the width of the tape. The split of the sliding block into two symmetric halves necessitates sumptuous assembly, because the halves must be thrust onto the narrow sides of the tape. Moreover, the outer appearance of the divided sliding block is compromised.

BRIEF SUMMARY OF THE INVENTION

Starting from this, the present invention is based on the task to provide a pipette for operating a syringe with a tight housing.

The pipette for operating a syringe of the present invention has

- a bar-shaped housing,
- a fixture with an opening at the lower end of the housing for putting in a syringe with a fastening portion on the upper edge of a cylinder,
- a fixture body with a further fixture and a further opening on the lower end of the housing, for putting in a further fastening portion of a piston of the syringe,
- means for detachably holding the fastening portion in the fixture and the further fastening portion in the further fixture,
- means for displacing the fixture body within the housing in the longitudinal direction of the housing,
- which have a draw-up lever activated from the outside of the housing, which is connected to the fixture body via a connection element which grips through a straight slit extending in the longitudinal direction of the housing, characterised in

- that below the slit in the housing, a cover stripe covering the slit is held in the housing at two positions spaced apart from each other in the longitudinal direction of the slit, and
- that the connection element has a channel through which the cover stripe extends.

In the pipette of the present invention, the slit can always be covered up by the cover stripe, notwithstanding which position the fixture body occupies in the housing. This is achieved in that the cover stripe covers the slit from the downside and is held in the housing at positions spaced apart from each other in the longitudinal direction of the slit. However, the cover stripe has no connection to the housing on both long sides of the slit. Moreover, the connection element is provided with a channel across which the cover stripe extends. As a consequence, when the fixture body is displaced by actuating the draw-up lever, the connection element is guided along the cover stripe, which covers the slit on both sides of the connection element. Thus, the slit can be covered up completely in each position of the draw-up lever. Thus, any insight and entrance of dirt into the apparatus across the slit is effectively prevented. Due to the arrangement of the tape at the inner side of the slit, contaminations or damages of the tape by the user's hand, which narrowly encompasses the bar-shaped housing, or through other influences of the surroundings, can be avoided.

According to one embodiment of the pipette, the friction between the means for displacing the fixture body and/or other components movable in the housing, which are fixedly connected to these means, and components fixedly arranged in the housing is dimensioned such that the draw-up lever does not move along the slit automatically when the pipette is in vertical orientation. A friction brake is realised through this.

The friction brake prevents unintended displacement of the fixture body and the draw-up lever connected thereto, without additional components being required.

According to a preferred embodiment, the friction is dimensioned such that the draw-up lever does not move along the slit automatically when the pipette is in vertical orientation. According to a preferred embodiment, the friction is dimensioned such that the draw-up lever does not move automatically when the pipette in vertical orientation is moved by the user. The dimensioning of the friction is preferably adapted to the usual gentle movements of the user when taking, carrying, using and setting down a pipette. The friction effective between movable component and component that is fixedly arranged in the housing prevents displacement of the draw-up lever under the influence of the gravitation force acting on the draw-up lever, and as the case may be under the influence of acceleration forces. According to a preferred embodiment, the friction is dimensioned such that the draw-up lever does not move along the slit automatically when the pipette is in vertical orientation even then when the pipette is not equipped with a syringe. In this case, displacement of the draw-up lever is not counteracted by the friction between syringe piston and syringe cylinder.

A further advantage of the present invention is that the friction between movable component and fixedly in the housing arranged component can be determined by the guiding of the cover stripe across the channel. According to one embodiment of the present invention, the friction between connection element and covering stripe is dimensioned such that the draw-up lever does not move along the slit automatically when the pipette is in vertical orientation, or this friction is correspondingly dimensioned together with the friction between another pair of components movable in the housing and fixedly arranged in the housing.

The friction between covering stripe and connection element depends especially on the materials of cover stripe and connection element, on the geometric shape and the size of channel and cover stripe as well as on the bias by which the cover stripe is held in the housing. These parameters can be set such that the friction fulfils the criteria mentioned above.

According to another embodiment, the friction between a pair of components, from which one is movable in the housing and the other is fixedly arranged in the housing, and both are different from connection element and covering stripe, is dimensioned such that the draw-up lever does not move along the slit automatically when the pipette is in vertical orientation. The pair of components may be in particular a tooth bar for displacing the fixture body within the housing and a bearing block, fixedly connected to the housing, for bearing mounting a pivotal actuation lever of a pawl drive of the tooth bar. Further, this pair of components may be the draw-up lever that is movable relative to the housing, or the connection element, and the housing itself. The friction between the movable component and the component that is fixedly connected to the housing can also be dimensioned together with the friction between connection element and covering stripe, such that the draw-up lever does not move along the slit automatically when the pipette is in vertical orientation.

The present invention incorporates rigid cover stripes. According to a preferred embodiment, the cover stripe is flexible. A flexible cover stripe or cover tape is preferably held tensioned between the two positions that are spaced apart in the longitudinal direction of the slit.

According to a further embodiment, the cover stripe is elastic. Due to the elastic realisation, the cover stripe can expand, so that it does not break upon a load in the longitudinal direction. A load of the cover stripe in the longitudinal direction can be caused by slightly tilting the draw-up lever, e.g.

According to one embodiment, the cover stripe is flexible and the channel in the connection element has a flatly U-shaped course in the longitudinal direction of the cover stripe, so that the cover stripe in the channel is deflected from a plane in which it runs contiguously to the connection element. Close bearing of the flexible cover stripe against the edges of the slit is favoured by the U-shaped course of the channel, because the upper limit of the channel can be displaced away from the edges of the slit. Intrusion of dirt into the housing is effectively prevented by the close bearing of the flexible cover stripe against the edges of the slit. In addition, by the form of the channel, the flexible cover stripe is vaulted towards the edges of the slit at both sides of the connection element. By the deflection of the cover stripe in the channel, the friction between cover tape and connection element is increased, which counteracts unintended displacement of the fixture body in the housing.

According to a further embodiment, the channel in the connection element runs out curvedly with its mouths into the plane through the not deflected portions of the cover stripe. By this, a smooth transition of the cover stripe into the channel is achieved, and excessive friction between connection element and cover stripe is avoided when the draw-up lever is being moved.

According to a further embodiment, the fixture body is fixedly connected to at least one support element, which is supported on a support rally in the housing that is oriented parallel to the plane across the portions of the cover stripe outside of the connection element. Forces acting on the draw-up lever are deflected into the housing via support element and support rally. Thus, an overload of the cover stripe is avoided through this.

According to a further embodiment, the support elements are wings which project on different sides of the fixture body in a plane that is parallel to the plane in which the cover stripe is disposed contiguously to the connection element, and which engage in parallel grooves on the inner side of opposing walls of the housing. Uniform support and guiding of the fixture body in the housing is achieved by the wings.

According to a further embodiment, the connection element has a groove stone 70 engaging into the slit. The groove stone can guide the connection element in the slit.

According to a further embodiment, the connection element has a draw-up lever mount fixedly connected to the fixture body and disposed in the housing, as well as a draw-up lever carrier, gripping through the slit and connected to the draw-up lever, wherein the channel is formed between the draw-up lever mount and the draw-up lever carrier. This design is advantageous for making the channel, in particular when it has a curved course.

In the further embodiment, one wall of the channel is a lateral surface of the draw-up lever mount, and an opposing wall of the channel is a further lateral surface of the draw-up lever carrier. According to a further embodiment, the draw-up lever mount and the draw-up lever carrier are joined in the region of the channel, so that they form the channel together. The production of the channel is facilitated through this. Further, the assembly is particularly advantageous in this embodiment, because draw-up lever carrier and draw-up lever mount can be set onto the flat sides of the cover stripe when they are joined. Further, it is advantageous that the zone of joining or the contact surfaces, respectively, of draw-up lever mount and draw-up lever carrier are disposed within the housing, so that it does not disturb the outer appearance of the draw-up lever.

According to a further embodiment, the draw-up lever carrier has the groove stone According to a further embodiment, the cover stripe is held at two spaced apart positions on the two ends and/or outside of the two ends of the slit.

According to a further embodiment, the cover stripe is fastened on the housing at the and/or outside of the two ends of the slit in one or plural of the following ways: positive fit, adhesive joining or non-positive fit.

According to a further embodiment, the cover stripe is fastened on eyes or ears on pins which project from the inner side of the housing. Adhesive joining of the cover stripe to the housing can be made by hot staking. Fastening by non-positive fit can be performed by clamping fast with suitable clamping devices. A combination of all the three fastening methods is given for instance in that pins made of plastics, on which the cover stripe is held on eyes, are pressed flat by heat action, so that they are molten together with the cover stripe and bear against its outer side under bias.

According to a further embodiment, the cover stripe is elastic in the longitudinal direction and/or tensioned by means of a spring. Thus, by extra close bearing of the cover stripe against the edges of the slit, an appealing outer appearance and an increased protection of the housing interior against contaminations are achieved.

According to a further embodiment, the housing and the cover stripe are made of the same plastic material. An appealing outer appearance is favoured further by this. The housing and the cover stripe are preferably both made of polypropylene.

According to a further embodiment, the housing and the cover stripe are made of different materials. The wear properties, the flexibility and the colours for instance can be influenced through the selection of the material of the cover stripe. For instance, improved wear properties are required when it is intended to increase the brake effect of the friction brake. Moreover, it is possible to match the surface properties of the cover stripe, the roughness in particular, to the special requirements. The cover stripe can for instance be made of polyvinylidene fluoride (PVDF) or polycarbonate.

The means for holding the fastening portion in the fixture, and the further fastening portion in the further fixture, are preferably configured like those described in one of the documents of the state of the art mentioned in the beginning. The means for displacing the fixture body within the housing are preferably configured like those described in one of the documents of the state of the art mentioned in the beginning. In this respect, it is referred to the documents mentioned in the beginning, namely DE 29 26 691 C2, U.S. Pat. No. 4,406,170A, DE 44 37 716 C2, EP 0 679 439 B1, U.S. Pat. No. 5,591,408A, EP 056 229 B1, U.S. Pat. No. 5,620,660 A, EP 1 724 020 B1, U.S. Pat. No. 7,731,908 B2, EP 0 657 216 B1, U.S. Pat. No. 5,620,661 A, whose subject matter is incorporated into the present application by reference.

BRIEF DESCRIPTION OF THE SEVERAL VIEWS OF THE DRAWINGS

The present invention will be explained in more detail in the following by way of the attached drawings of exemplary embodiments. The drawings show.

In the present application, the designations "up" and "down" refer to the orientation of the pipette in which the bar-shaped housing is oriented vertically, and the fixture for the syringe is disposed at the downside.

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figure 1:
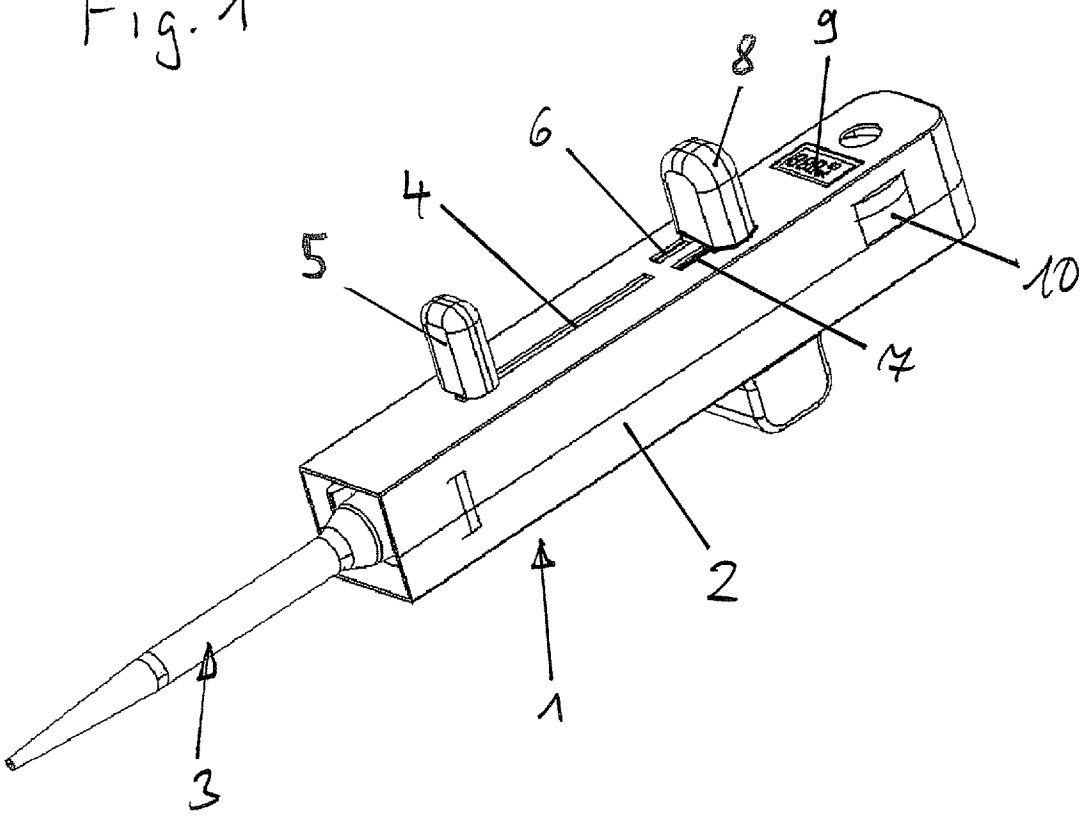
FIG. 1 a pipette of the present invention with syringe held therein, in a perspective view from the side.

According to FIG. 1, a pipette 1 has a bar-shaped housing 2, in which a syringe 3 is held at the downside. From a side wall of the housing 2, a draw-up lever 5 (also referred to as a draw-up key 5) projects from the housing 2 above a straight slit 4. An actuation button 8 of a tooth bar pawl control projects from the same side wall of the housing above two further slits 6, 7. Above it, a LCD display 9 is countersunk into the same side wall of the housing 2. Segments of a dial 10 project from openings in the neighbouring side wall.

Figure 2:
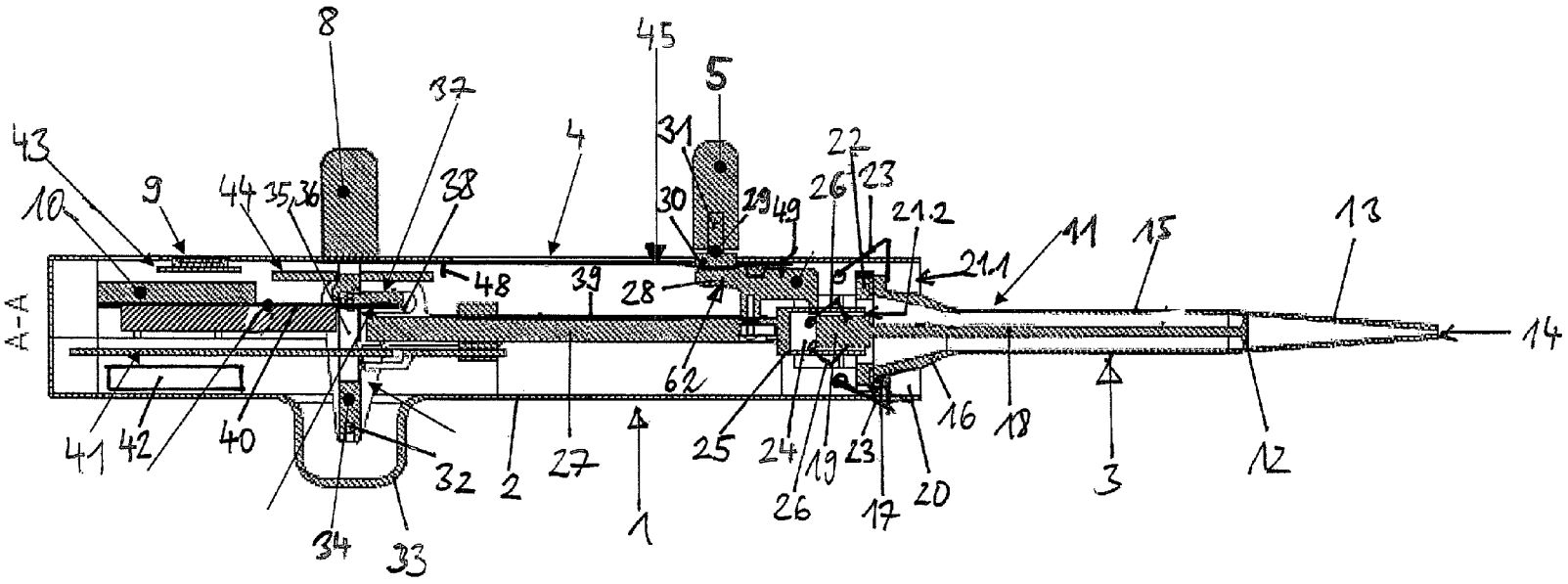
FIG. 2 the same pipette in a longitudinal section.

According to FIG. 2, the syringe 3 has a cylinder 11 and a piston 12 movably arranged therein. The cylinder 11 has a conical portion 13 with a hole 14 for the passage of liquids at the downside, and above it a cylindrical portion 15 in which the piston 12 can be displaced. At the upside, the cylinder 11 has a fastening portion 16 with a circumferential flange 17. A piston rod 18 projects towards the upside from the piston 12, which has a further fastening portion 19 with several circumferential bulges (not shown).

The syringe 3 is arranged with its flange 17 in a fixture 20 at the lower end of the housing 2, which has an axially directed opening 21.1 for insertion and withdrawing of the syringe 3 at the lower end of the housing 2. With its topside, the syringe 3 pushes against a pressure-sensitive ring sensor 22, which scans projections on the upper edge of the flange 17. The flange 17 is kept in the housing 2 in this position by means of spring fasteners 23.

The further fastening portion 19 of the piston 12 is disposed in a further fixture 24 in a hollow-cylindrical fixture body 25. The latter has a further axially oriented opening 21.2 for inserting the fastening portion 19. The further fastening portion 19 is held with further gripping levers 26, which engage between the bulges of the further fastening portion 19 or clamp it in.

The fixture body 25 is fixedly connected to a tooth bar 27, which extends below the slit 4 in the longitudinal direction of the housing 2.

A draw-up lever mount 28 (also referred to as a draw-up key mount 28) is fixed on the fixture body 25 and on a lower part of the tooth bar 27.

Further, there is a draw-up lever carrier 29 (also referred to as a draw-up key carrier 29), which bears against the lower side of the edges of the slit 4 with a sliding board 30. The draw-up lever carrier 29 has an upward-projecting post 31 which grips through the slit 4. Outside of the housing 2, the draw-up lever 5 is fixed on the post.

In the upper half of the housing 2, a metering lever 34 is pivotally mounted in a hinge bearing 32 in a bulge 33 of the side wall of the housing 2 opposite to the slit 4. The metering lever 34 has two spaced apart legs 35, 36, which stand out of the two slits 6, 7 on the opposite side wall of the housing 2. The actuation button 8 is fixed there on the projecting ends of the legs 35, 36.

Between the two legs 35, 36 of the metering lever 34, a pawl 37 is pivotally mounted. The pawl 37 is arranged above the toothing 39 of the tooth bar 27 with a pawl tooth 38. The metering lever 34 is pressed into the position of FIG. 2 by a not shown spring device. Against the action of the spring device, the metering lever 34 can be swung towards the downside by actuating the actuation button 8. The pawl 37 is pushed towards the toothing 39 of the tooth bar 27 by a not shown further spring device.

A movable covering 40 is arranged between pawl 37 and tooth bar 27. The covering 40 can be moved by turning the dial 10 which projects laterally out of the housing 2, so that it covers the toothing 39 of the tooth bar 27 more or less.

Further, a circuit board 41 with electronics is arranged in the upper half of the housing 2. Here is also situated a power supply in the form of batteries or accumulators 42.

A further sensor 43 is assigned to the dial 10, which acquires the position of the dial 10. The measurement values determined by the ring sensor 22 and the further sensor 43 are forwarded to the electronics via cable.

The code indicated on the flange 17 designates the size of the respective syringe 3. From the measurement signals provided by the ring sensor 22, the electronics determines the respective syringe size, and from the setting of the dial 10 the respective step width. From these it calculates the set metering volume and displays it on the display 9.

At the inside, the slits 6, 7 are covered by a diaphragm 44 connected to the metering lever 34.

According to FIGS. 3 to 5, a flexible cover stripe 45 exists in the housing 2 below slit 4 in order to cover up the slit 4. The cover stripe 45 is made of polypropylene. According to FIG. 8, the cover stripe 45 has eyes 46, 47 at its ends, which are fixed on pins 48, 49 according to FIG. 2, which project from the inner side of that side wall of the housing 2 which has the slit 4.

Figure 3:
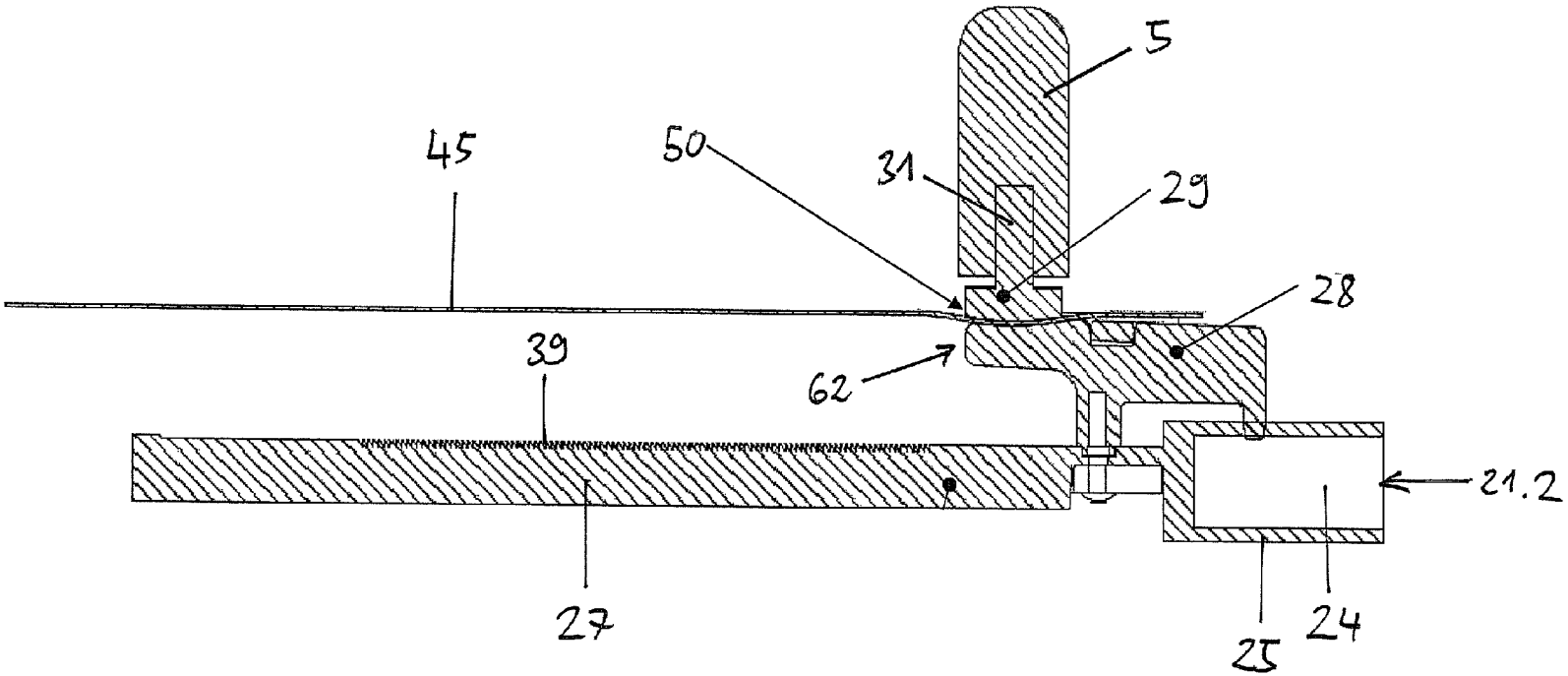
FIG. 3 fixture body with tooth bar, connection element, draw-up lever and cover tape of the same pipette in a magnified partial section in the longitudinal direction.
Figure 4:
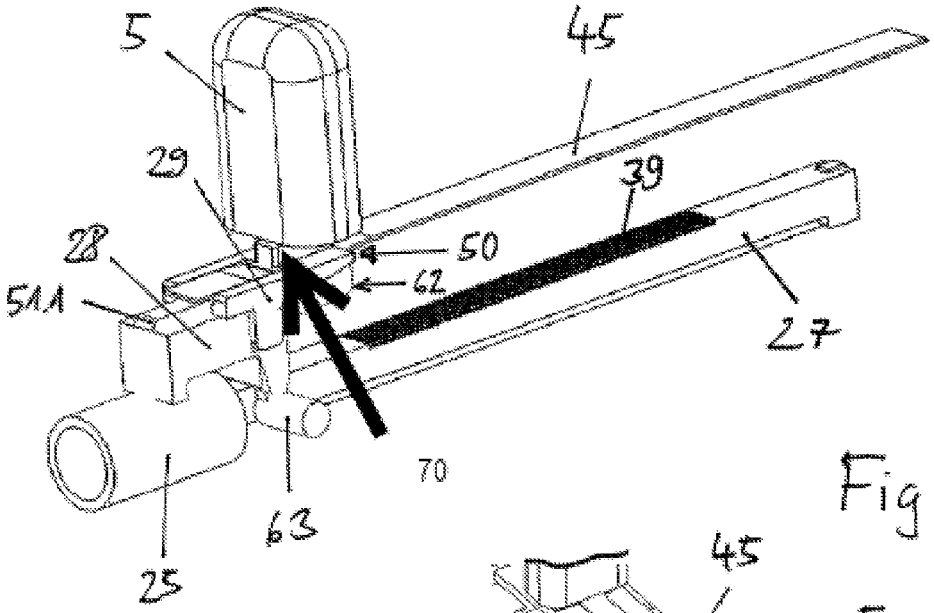
FIG. 4 the same configuration in a perspective partial view from the side.
Figure 5:
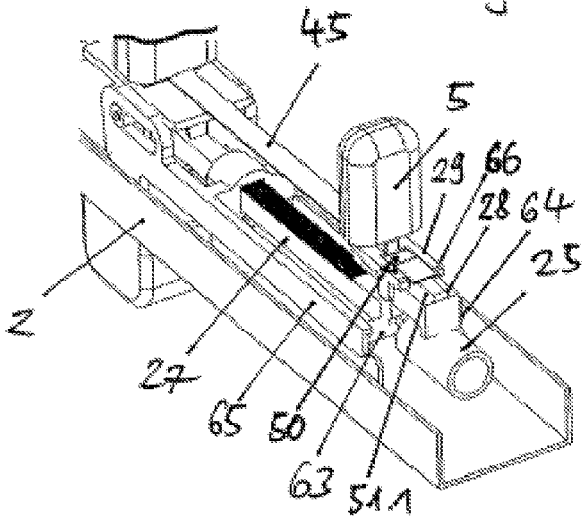
FIG. 5 the same configuration in a housing half of the pipette in a perspective partial view from another side.
Figure 7:
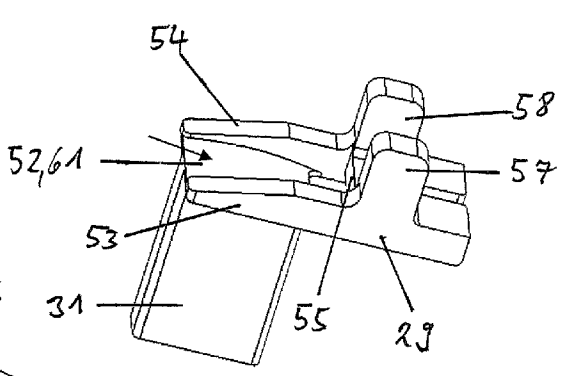
FIG. 7 the draw-up lever carrier in a perspective view from the other side.
Figure 6:
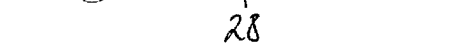
FIG. 6 the draw-up lever mount in a perspective view from the side.

According to FIGS. 3 to 5, the cover stripe 45 runs through a channel 50 between draw-up lever mount 28 and draw-up lever carrier 29. According to FIGS. 6 and 7, the channel 50 is limited on opposing sides by a lateral surface 51 with a radius of the draw-up lever mount 28 and by a further lateral surface 52 with corresponding radius of the draw-up lever carrier 29. The two lateral limits of the channel 50 are formed by two stripe-shaped side walls 53, 54 of the draw-up lever carrier 29. These are connected to each other by a cross member 55 in a distance from the lateral surface 52 that has the radius. Between the further lateral surface 52 having the radius and the cross member 55, the draw-up lever carrier has a breakthrough 56. From one side of the cross member 55 project two projections 57, 58, which can be put into corresponding pockets 59, 60 of the draw-up lever mount 28. The two stripe-shaped side walls 53, 54 are bridged by a front wall 61, which has the further lateral surface 52 with the radius at the downside, and from which the post 31 projects at the upside.

Figure 8:
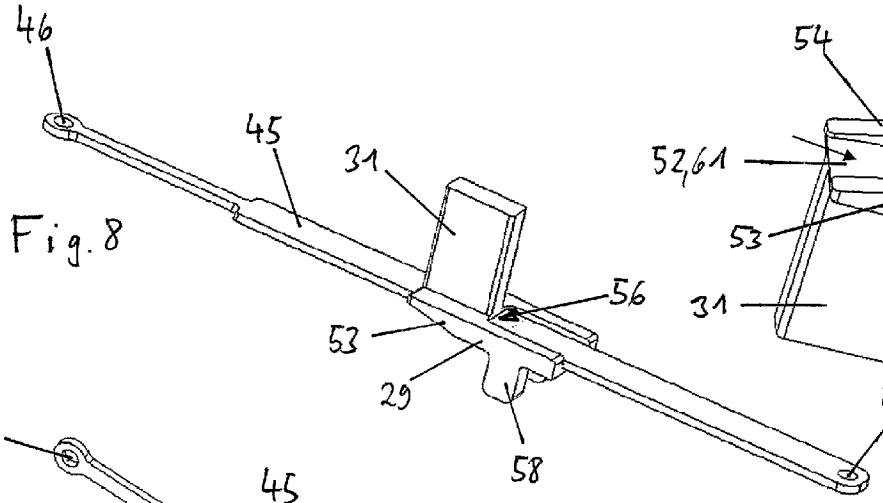
FIG. 8 the draw-up lever carrier with inserted cover tape in a perspective view from the side.
Figure 9:
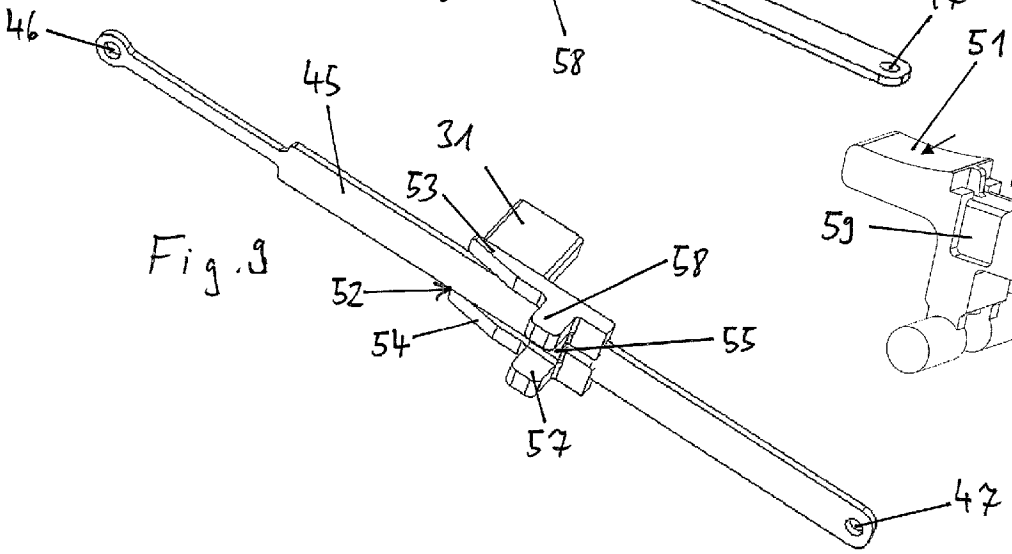
FIG. 9 the draw-up lever carrier with inserted cover tape in a further perspective view.

According to FIGS. 8 and 9, the draw-up lever carrier 29 can be pre-assembled with the cover stripe 45 by guiding the cover stripe 45 along the further lateral surface 52 and across the breakthrough 56, so that it runs on the topside of the cross member 55 between the two stripe-shaped side walls 53, 54. In this configuration, the draw-up lever carrier 29 can be connected to the draw-up lever mount 28 by putting the projections 57, 58 into the pockets 59, 60 and draw-up lever carrier 29 and draw-up lever mount 28 are glued together or snapped together by suitable snapping means. The cover stripe 45 is then arranged in the channel 50 between lateral surface 51, further lateral surface 52 and side walls 53, 54. At one side next to the draw-up lever carrier 29, the cover stripe 45 rests on a projecting rib 51.1 of the draw-up lever mount 28 that extends in the longitudinal direction of the slit 4 (compare FIGS. 4 to 6).

Draw-up lever mount 28 and draw-up lever carrier 29 form together a connection element 62 between fixture body 25 and draw-up lever 5 (compare FIG. 2, 3, 4).

According to FIGS. 4 and 5, the draw-up lever mount 28 has wings 63, 64 which project from both sides. In the example, the wings 63, 64 have a cylindrical shape. They engage into grooves 65, 66 on two opposing side walls of the housing 2. The grooves 65, 66 are limited by an edge of a housing half at one side, and on the other side by a ledge of a chassis in which parts of the drive mechanics of the pipette 1 are mounted.

According to FIG. 2, on the eyes 46, 47, the cover stripe 45 is held stretched at the inner side of the slit 4 by the two pins 48, 49 according to FIG. 8, 9.

According to FIG. 3, it is vaulted on the plane in which it extends on both sides of the channel 50 due to the radii of the lateral surfaces 51, 52 of the channel 50. Close bearing of the cover stripe 45 against the edges of the slit 4 is obtained through this.

In order to draw up liquid through the opening 14 of the syringe 3, the draw-up lever 5 is pushed upward from the position of FIGS. 1 and 2. The liquid drawn up can be discharged in small steps by repeatedly pushing the actuation button 8 downward against the action of the spring device. In this, the further spring device pushes the pawl 37 with the pawl tooth 38 against the covering 40, until the pawl tooth 38 reaches the lower end of the covering 40. Thereafter, the pawl 37 falls into the toothing 39 of the tooth bar 27 with its pawl tooth 38, and takes the tooth bar 27 somewhat along when the metering lever 34 is further swung downward. In this, the displacement of the tooth bar 27 in each swinging of the metering lever 34 till the arrival at a lower stop depends on a position of the covering 40 that is set by means of the dial 10. After unloading the actuation button 8, it is pushed upward by the spring device, and a further metering step can be performed. This is possible for so long until the residual amount of liquid remaining in the syringe 3 is smaller than the set metering amount. A residual stroke lock provides that the covering 40 is swung against the lower side of the pawl 37, so that the pawl tooth 38 can no more fall into the toothing 39.

When the draw-up lever 5 is displaced, the cover stripe 45 is guided across the channel 50. The slit 4 remains always covered up. Unintended displacement of the fixture body 25 and of the connection element with the draw-up lever 5 as well, is counter-acted by the friction between cover stripe 45 and connection element.

The above disclosure is intended to be illustrative and not exhaustive. This description will suggest many variations and alternatives to one of ordinary skill in this art. All these alternatives and variations are intended to be included within the scope of the claims where the term "comprising" means "including, but not limited to". Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

LIST OF REFERENCE SIGNS

1 pipette
2 housing
3 syringe
4 slit
5 draw-up lever
6 slit
7 slit
8 actuation button
9 display
10 dial
11 cylinder
12 piston
13 portion
14 hole
15 portion
16 fastening portion
17 flange
18 piston rod
19 fastening portion
20 fixture
21.1 opening
21.2 opening
22 ring sensor
23 gripping lever
24 fixture
25 fixture body
26 gripping lever
27 tooth bar

28 draw-up lever mount
29 draw-up lever carrier
30 sliding board
31 post
32 hinge bearing
33 bulge
34 metering lever
35 leg
36 leg
37 pawl
38 pawl tooth
39 toothing
40 covering
41 circuit board
42 accumulator
43 sensor
44 diaphragm
45 cover stripe
46 eye
47 eye
48 pin
49 pin
50 channel
51 lateral surface
51.1 rib
52 lateral surface
53 side wall
54 side wall
55 cross member
56 breakthrough
57 projection
58 projection
59 pocket
60 pocket
61 wall
62 connection element
63 wing
64 wing
65 groove
66 groove

The invention claimed is:

1. Pipette for actuating a syringe, comprising:

a bar-shaped housing (2), having housing walls accommodation means (20) located at a lower end of the housing, for the accommodation of a syringe (3), the syringe (3) having a cylinder (11) and a fastening portion (16) on the upper end of the cylinder (11), an accommodation body (25) with further accommodation means (24) for the accommodation of a further fastening portion (19) of a piston (12) within the syringe (3), spring fasteners for detachably holding (23, 26) the fastening portion (16) in the accommodation means (20) and means (26) for detachably holding the further fastening portion (19) in the further accommodation means (24), means for displacing (5, 8, 34, 37, 27) the accommodation body (25) within the housing (2) in the longitudinal direction of housing (2), the means for displacing having a draw-up key (5) actuated from the outside of the housing (2), and being connected to the accommodation body (25) via a connection element (62) which extends through a straight slit (4) extending in a longitudinal direction of a wall of the housing (2), characterised in that a cover stripe (45) is fixedly held within the housing (2) at two spaced apart positions (48, 49) and extends in the longitudinal direction of the slit (4) and covers the slit (4) from below, the stripe (45) extends through a channel (50) of a portion of the connection element (62) located within housing (2), so that slit (4) is covered from below independent from the position of the draw up key (5) and the connection element (62).

2. The pipette according to claim 1, wherein the friction between the means for displacing (5, 8, 34, 37, 27) the accommodation body (25) and/or other components movable in the housing, which are fixedly connected to the means for displacing, and components fixedly arranged in the housing is dimensioned such that the draw-up key (5) does not move along the slit (4) automatically when the pipette is in vertical orientation.

3. The pipette according to claim 2, wherein the friction between connection element (62) and covering stripe (45) is dimensioned such that the draw-up key (5) does not move along the slit (4) automatically when the pipette is in vertical orientation, or is correspondingly dimensioned together with the friction between another pair of components movable in the housing (2) and fixedly arranged in the housing (2).

4. A pipette according to claim 1, characterised in that the cover stripe (45) is flexible.

5. The pipette according to claim 4, characterised in that the channel (50) in the connection element (62) has a flatly U-shaped course in the longitudinal direction of the cover stripe (45), so that the cover stripe (45) in the channel (50) is deflected from a plane in which it runs contiguously to the connection element (62).

6. A pipette according to claim 1, characterised in that the channel (50) in the connection element (62) runs out curvedly with its mouths into the plane through the deflected portions of the cover stripe (45).

7. A pipette according to claim 1, characterised in that the accommodation body (25) is fixedly connected to at least one support element (63, 64), which is supported on a support rally (65, 66) in the housing (2) that is oriented parallel to the plane across the portions of the cover stripe (45) outside of the connection element (62).

8. The pipette according to claim 7, characterised in that the support elements (63, 64) are wings which project on different sides of the accommodation body (25) in a plane that is parallel to the plane in which the cover stripe (45) is disposed contiguously to the connection element (62), and which engage in parallel grooves (65, 66) on the inner side of opposing walls of the housing (2).

9. A pipette according to claim 1, characterised in that the connection element (62) has a groove stone engaging into the slit (4).

10. A pipette according to claim 9, characterised in that the draw-up key carrier (29) has the groove stone.

11. A pipette according to claim 1, characterised in that the connection element (62) has a draw-up key mount (28) fixedly connected to the accommodation body (25) and disposed in the housing (2), as well as a draw-up key carrier (29), extending through the slit and connected to the draw-up key (5), wherein the channel (50) is formed between the draw-up key mount (28) and the draw-up key carrier (29).

12. The pipette according to claim 11, characterised in that one wall of the channel (50) is a lateral surface (51) of the draw-up key mount (28) and an opposing wall of the channel is a further lateral surface (52) of the draw-up key carrier (29).

13. The pipette according to claim 12, characterised in that the draw-up key mount (28) and the draw-up key carrier (29) are joined components.

14. A pipette according to claim 1, characterised in that the cover stripe (45) is held at two spaced apart positions (48, 49) on the two ends and/or outside of the two ends of the slit (4).

15. A pipette according to claim 1, characterised in that the cover stripe (45) is fastened on the housing (2) beyond the two ends of the slit (4) in one or plural of the following ways: positive fit, adhesive joining or non-positive fit.

16. The pipette according to claim 15, characterised in that the cover stripe is fastened on eyes (46, 47) or ears on pins (48, 49) which project from the inner side of the housing (2).

17. A pipette according to claim 1, characterised in that the cover stripe (45) is elastic in the longitudinal direction and/or tensioned in the longitudinal direction by means of a spring.

18. A pipette according to claim 1, characterised in that the housing (2) and the cover stripe (45) are made of the same plastic material or of different plastic materials.

19. Pipette for actuating a syringe, comprising:

a bar-shaped housing (2), having housing walls accommodation means (20) located at a lower end of the housing, for the accommodation of a syringe (3), the syringe (3) having a cylinder (11) and a fastening portion (16) on the upper end of the cylinder (11), an accommodation body (25) with a further accommodation means (24) for the accommodation of a further fastening portion (19) of a piston (12) within the syringe (3), spring fasteners for detachably holding (23, 26) the fastening portion (16) in the accommodation means (20) and means (26) for detachably holding the further fastening portion (19) in the further accommodation means (24), displacement mechanism (5, 8, 34, 37, 27) for displacing the accommodation body (25) within the housing (2) in the longitudinal direction of the housing (2), the displacement mechanism having a draw-up key (5) actuated from the outside of the housing (2), and being connected to the accommodation body (25) via a connection element (62) which extends through a straight slit (4) extending in the longitudinal direction of the housing (2), wherein that below the slit (4) in the housing (2), a cover stripe (45) covering the slit is held in the housing (2) at two positions (48, 49) spaced apart from each other in the longitudinal direction of the slit (4), and that the connection element (62) has a channel (50) through which the cover stripe (45) extends.

* * * * *